United States Patent [19]

Stein

[11] 4,125,104

[45] Nov. 14, 1978

[54] FUEL INJECTION PUMP FOR INTERNAL COMBUSTION ENGINES

[76] Inventor: Günter Stein, Weihengaier Str. 1, 8882 Lauingen Donau, Germany

[21] Appl. No.: 828,126

[22] Filed: Aug. 26, 1977

[30] Foreign Application Priority Data

Aug. 27, 1976 [DE] Fed. Rep. of Germany ..... 2638736

[51] Int. Cl.[2] ..... F02D 1/04

[52] U.S. Cl. ..... 123/179 L; 417/462; 123/140 MP; 123/139 AL; 123/140 R; 123/140 FG

[58] Field of Search ..... 123/179 L, 139 ST, 139 AP, 123/139 AC, 139 BC, 139 BD, 140 FG, 140 MP, 139 BG, 139 AB, 140 MC, 139 AF; 417/462, 221, 218

[56] References Cited

U.S. PATENT DOCUMENTS

| | | | |
|---|---|---|---|
| 2,828,727 | 4/1958 | Fischer | 123/140 R |
| 3,363,568 | 1/1968 | Evans | 123/139 AL |
| 3,489,093 | 1/1970 | Thornber | 123/139 AL |
| 3,650,259 | 3/1972 | Garnier | 123/140 FG |
| 3,676,023 | 7/1972 | Andrusenko et al. | 417/462 |
| 3,695,244 | 10/1972 | Vauille | 123/140 R |
| 3,924,593 | 12/1975 | Pagdin | 123/179 L |
| 4,050,437 | 9/1977 | Hollett et al. | 417/462 |
| 4,067,304 | 6/1978 | Potter | 417/462 |

*Primary Examiner*—Charles J. Myhre
*Assistant Examiner*—R. A. Nelli
*Attorney, Agent, or Firm*—Edwin E. Greigg

[57] ABSTRACT

A fuel injection pump is driven by the engine via a drive shaft that also rotates a cam ring. The cam ring reciprocates radial pistons which deliver fuel under high pressure to fuel lines located around an axially sliding distribution member. The amount of fuel delivered is determined in part by the timing of the opening of a pressure relief channel which is opened by a sliding annular ring surrounding the distribution member. The position of this ring and hence the fuel quantity delivered is adjusted by the equilibrium between spring forces and fluid pressure from a regulating valve. A separate pressure control valve adjusts the pressure gradient across an arbitrarily settable throttle which also affects the regulating pressure. Separate mechanisms adjust an engine starting excess quantity and a fuel bypass which is thermostatically controlled to maintain the pump operating temperature within prescribed limits.

22 Claims, 4 Drawing Figures

FUEL INJECTION PUMP FOR INTERNAL COMBUSTION ENGINES

BACKGROUND OF THE INVENTION

The invention relates to a fuel injection pump for use in internal combustion engines, including a fuel distributor driven in rotation at a speed synchronous with the engine speed. The pump further includes a valve slide surrounding the fuel distribution member and displaceable axially by a hyraulic control mechanism. Control edges, surfaces and recesses internal to the valve slide cooperate with radial bores in the fuel distribution member of the pump for controlling the overall injected fuel quantity. The pump is supplied with fuel by a fuel supply pump which is driven at a speed proportional to the engine rpm. In a known fuel injection system of this type, for example as described in U.S. Pat. No. 2,828,727, the possibilities for adaptation to the present day requirements made of engine manufacturers are very limited. In addition, the hydraulic regulator is separate from the actual injection pump.

OBJECT AND SUMMARY OF THE INVENTION

It is a principal object of the invention to provide a fuel injection pump which permits a multiple adaptation of its regulating characteristics to the requirements of any particular engine. This and other objects are attained according to the invention by providing a pump which delivers a fuel quantity that increases with increasing rpm and which includes an arbitrarily actuatable throttle located in the pressure line of the supply pump which causes an rpm-dependent pressure gradient for the hydraulic regulator. The fuel injection pump according to the invention further provides a spring loaded pressure control valve for defining the pressure downstream of the throttle and for admitting an increasing control pressure when the fuel quantity increases. The fluidic pressure which causes the displacement of the annular valve slide is due to the pressure drop across the throttle. A particular advantage of the invention is that the control pressure and the regulated pressure are substantially independent of one another.

Another object of the invention is that regulating means are provided for the direct adjustment of the axial position of the annular valve. Another object of the invention is to provide means for changing the timing of the injection within the pumping cycle. Yet another object of the invention is to provide for a novel generation of the engine-starting fuel increase. Yet another object of the invention is to provide a novel manner of cooling the fuel injection pump.

The invention will be better understood as well as further objects and advantages thereof become more apparent from the ensuing detailed description of two exemplary embodiments taken in conjunction with the drawing.

DESCRIPTION OF THE PREFERRED EMBODIMENTS

Figure 1:
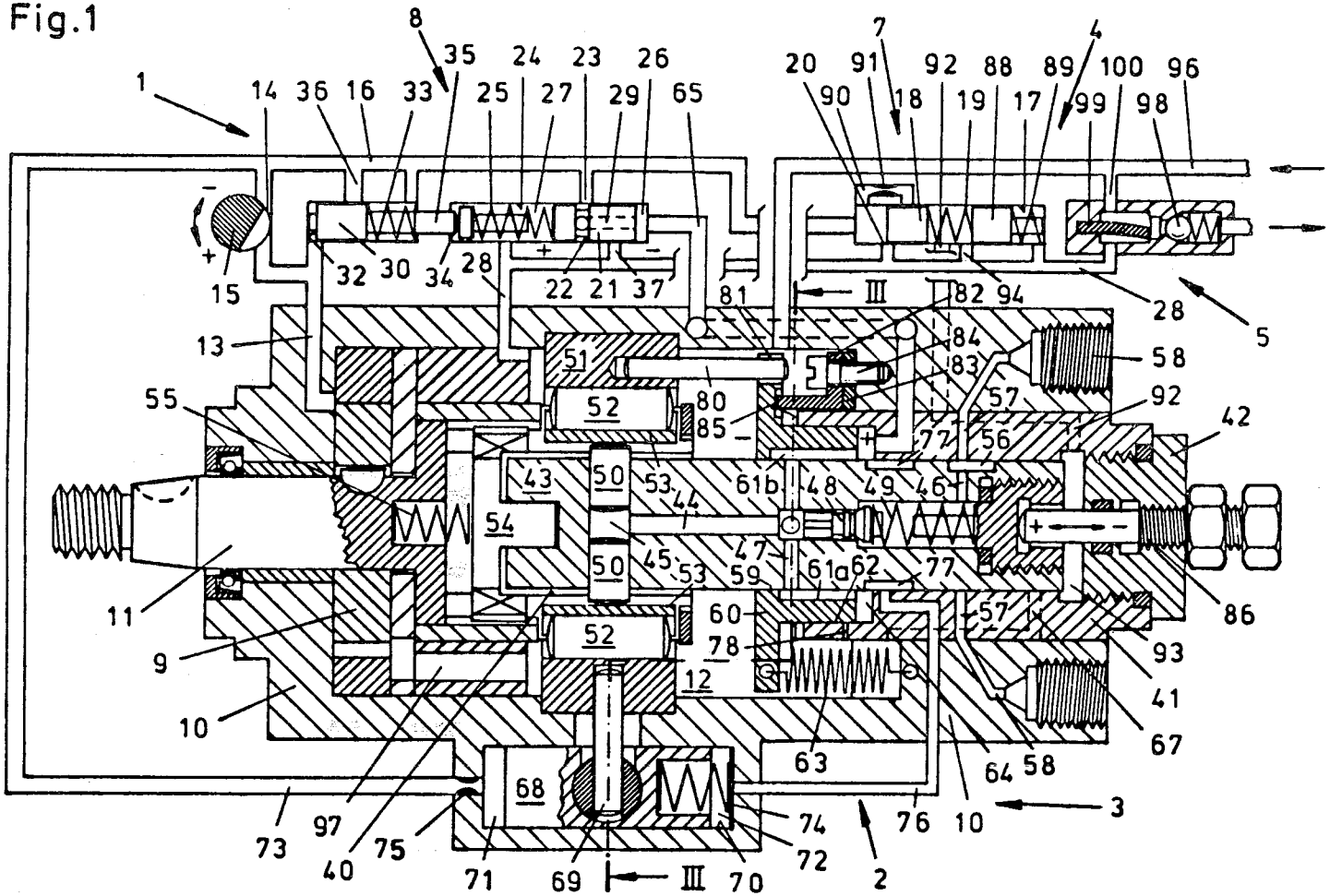
FIG. 1 is a longitudinal cross section through a fuel injection pump according to the invention.

The illustrated exemplary embodiments of the invention are radial piston type distributor injection pumps having a hydraulic regulator. However, fuel injection pumps in which the fuel distributor and the pump element are separated also would fall within the spirit and scope of the invention.

The fuel injection pump and its regulator include the following main constituents which will be described in detail below:

A hydraulic pressure regulator 1, an annular valve control mechanism 2 for controlling the injected fuel quantity, an injection time adjustment 3, an engine start surplus control 4 as well as a control mechanism 5 for determining the pump temperature.

The hydraulic regulator includes a pressure control valve 7 as well as a pressure regulating valve 8. The pressure control valve generates a pressure which changes with rpm, in particular, in the exemplary embodiment shown, the pressure increases with increasing rpm. By contrast, the pressure regulating valve 8 produces a per se constant regulating pressure which, however, is changed as a function of rpm and load and which serves for actuating a control member affecting the quantity of injected fuel. The fuel injection pump also includes a fuel supply pump 9 driven at an rpm equal to the engine rpm and mounted rotatably within the housing 10 of the fuel injection pump. The supply pump is driven by the drive shaft 11 of the injection pump. The supply pump 9 aspirates fuel at low pressure from the interior volume 12 of the housing 10 and delivers it via a supply pump pressure line to the hydraulic pressure regulator 1. The flow cross section of the line 13 is controlled at least at one throttle 14 by an arbitrarily settable throttle element 15. The amount of fuel delivered by the fuel pump 9 increases uniformly with rpm and its static pressure depends on the position of the throttle element 15 ahead of the throttle location 14. In motor vehicles, the arbitrarily settable throttle element 15 may be connected with the gas pedal, for example.

The supply line 13 terminates downstream of the throttle location 14 into a control pressure line 16 which, in turn, terminates in a control pressure cylinder 17. The control pressure cylinder 17 includes a control pressure piston 18 which can be slidably displaced in opposition to the force of a control spring 19 and which opens an aperture 20 to varying degrees. If the fuel quantity supplied by the pump 9 via the control pressure line 16 increases, the control pressure piston 18 is moved against the force of the spring 19 in the sense of opening a larger aperture 20. The characteristics of the spring 19 and the shape of the aperture 20 together constitute a characteristic curve of control pressure versus rpm. Depending on the requirements, this characteristic curve can be linear, shallow or steep, or even curved. Pressure control valves of this type are known per se. The control pressure is not influenced directly by the throttle location 14 because any fuel quantity from the pump 9 must pass this throttle. The pressure regulating valve 8 belonging to the hydraulic pressure regulator 1 operates in a different manner. Inasmuch as the regulating pressure directly defines the injected fuel quantity, it must change in a load-dependent manner. For example, if the vehicle is climbing an incline so that the load on the engine increases and the motor rpm tends to drop, the operator attempts to increase the rpm by depressing the gas pedal further. Thus, the arbitrarily settable throttle element 38 is adjusted in a load-dependent manner. Any such adjustment must therefore have an immediate influence on the pressure generated by the pressure regulating valve.

The pressure regulating valve has a regulating piston 21 which carries an annular groove 22 that controls the terminus of a bore 23 communicating with the control pressure line 16. The regulating piston 21 is slidably disposed within a regulating cylinder 24 and moves in opposition to the force of a regulating spring 25. The regulating piston 21 divides the cylinder 24 into two regions 26 and 27. The region 27 which includes the spring 25 is connected via a line 28 with the interior 12 of the pump experiencing low pressure, whereas the region 26 communicates via a bore 29 in the piston 21 with the annular groove 22. Depending on which of the two pressures is present in the chamber 26, the regulating piston 21 is displaced in opposition to the spring 25 and changes the free cross section 23 by means of the annular groove 22. The manner of changing the flow cross section is essentially pressure relieved so that any constriction of the cross section results in a diminution of the pressure in the cylinder region 26, and an augmentation of the cross section 23 results in an increase of that pressure. It is assumed throughout that fluid may flow out of the cylindrical region 26 to a member which determines the injected fuel quantity. If a great deal of fuel flows off, the pressure in the cylinder region 26 also changes. Thus, the cross section 23 depends on the force of the spring 25 as well as on the pressure in the cylinder region 26 so that a pressure change results in a cross section change. In order to permit the regulating pressure to be changeable in load-dependent manner, one of the variables which define that pressure must be changed. According to this invention, this change takes place by altering the bias tension of the regulating spring 25. For this purpose, there is disposed a spring tensing piston 30, embodied as a stepped piston, whose annular surface experiences the control pressure of line 16 and whose large face 32 experiences the pressure prevailing upstream of the throttle location 14. A spring 33 further acts on the stepped piston 30 in the direction of the control pressure. The face 34 of the piston section 35 having the smaller diameter extends into the region 27 of the regulating cylinder 24 in which low pressure prevails. Thus, when the rotation of the throttle element 15 diminishes the size of the throttle 14, and if the rpm remains constant, the pressure in the pressure line 13 upstream of the throttle location 14 will increase. Due to this pressure increase, the spring tensing piston 30 is displaced in opposition to the spring 33, and the regulating spring 25 is loaded more heavily. The increased loading of the regulating spring 25 causes the regulating piston 21 to be pushed further into the region 26, i.e., the cross section 23 is opened to a greater extent. Thus, the pressure drop across the location 23 is diminshed and, if the rpm remains constant, the pressure in the cylindrical region 26 will increase. Such a pressure change must then result in a corresponding load-dependent reduction of the injected fuel quantity.

As soon as the amount of fuel flowing out of the control pressure line 16 through the location 23 changes, the control pressure in the line 16 also changes with respect to the speed of operation of the supply pump 9. In the present exemplary embodiment, the amount of fuel which is used for injection also flows through this cross section and changes in both load as well as rpm-dependent manner. This means that the control pressure also changes, not only rpm-dependently but also, within certain limits, load-dependently. Such an effect may be desirable, as will be explained further below. If it is not desirable, then the amount of fuel injected must be taken from the interior of the pump 12 instead of from the control pressure line 16 as is the case in known distribution injection pumps, or the fuel which is not required for injection must be pushed into the interior of the pump via the groove 61*a*. For that purpose, the groove 61*a* must be closed on the side adjacent the pressure chamber 64 and must be open on the side facing the interior 12 of the pump. The location and the width of the grooves 61 must be such that, when groove 61 is open, no fuel can flow from the pressure chamber 64 through the supply bores 47 into the interior 12 of the pump. The above-described hydraulic pressure regulator is by no means limited to the described example but may be used as a hydraulic regulator for fuel injection pumps of different construction.

A particular advantage of the pressure regulator according to the present invention is that pressure changes can be achieved rapidly and reliably and that any pressure attained will be constant if the related variables no longer change. In order to limit the stroke of the spring tensioning piston, the face 32 thereof opens an overflow bore 36 after traversing a maximum stroke corresponding to a maximum static pressure. In that position of the spring tensing piston 30, the regulating spring 25 is loaded to its maximum, i.e., the regulating piston 21 lies adjacent the face of the regulating cylinder 24. In that position, the cross section 23 experiences the least amount of throttling and thus results in the highest regulating pressure for a particular rpm. In the present exemplary embodiment this means that, when the regulating pressure is high, the tendency is to admit less fuel, whereas when the regulating pressure is low, the tendency is to increase the amount of fuel from whatever its instantaneous value happens to be. The magnitude of the regulating pressure within the cylinder region 26 is limited by an overflow bore 37 which terminates in the line 28 in which low pressure prevails and which is opened by the corresponding end face of the regulating piston 21 as soon as the latter has traversed its maximum stroke in opposition to the force of the regulating spring 25. The hyraulic pressure regulator illustrated in FIG. 1 is a so-called servo regulator, i.e., any position of the throttle element 15 results in an automatic regulation of a particular rpm, especially during load changes. Such a servo regulator requires a greater regulating time than would be required by a direct mechanical engagement. In principle however, for practical reasons and for safety reasons, the idling and the maximum rpm must be fully regulated. Any mechanical adjustment during idling might result in stalling the engine and at maximum rpm might result in running the engine at excessive speed.

Figure 2:
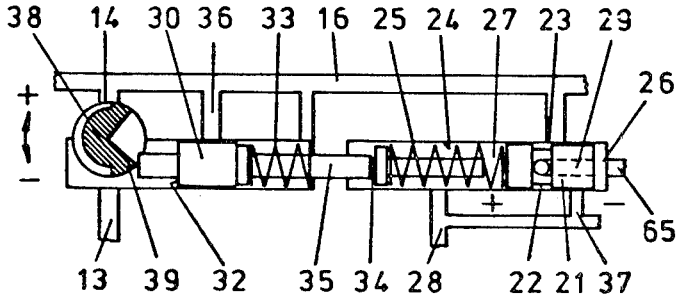
FIG. 2 is a section of FIG. 1 relating to a second example of the pressure regulator according to the invention.

FIG. 2 illustrates a hydraulic pressure regulator which is identical to that shown in FIG. 1 except for the throttling element 15. This so-called idling regulator really operates in the described manner only at idle and at maximum rpm whereas, in the intermediate rpm regions, a differently embodied throttle element 38 having cams 39 directly engages the spring tensing piston 30. Since the spring tensing piston 30 directly changes the injected fuel quantity, the fuel quantity change as a function of rpm is eliminated by this idling regulator in the intermediate rpm region. Only at idle and at maximum rpm, i.e., when the cam 39 does not engage the spring tensing piston 30 does there take place a purely hyraulic pressure regulation.

The housing 10 of the injection pump includes a bushing 41 which is closed by a plug 42. A distribution member 43 is located within the bushing 41 and is capable of axial and rotating motion. The distribution member 43 has a central bore 44 terminating at one end in the pump working chamber 45 and at the other end communicating with a distribution bore 46 leading radially outward. Radial fuel supply bores 47 are disposed between the pump chamber 45 and the distribution bore 46. Disposed in the central bore 44 between the terminus of the supply bore 47 and the distribution bore 46 is a central pressure valve 48 which is displaceable against the force of a spring 49. The pump chamber 45 is defined between two radial pistons 50. The radial pistons are driven by a cam ring 51 working via rollers 52. The rollers 52 are disposed within races 53 rotating with the distributor. The region of the distribution member 43 in which the radial pistons are disposed extends into an inner bore 40 of the enlarged end of the drive shaft 11. An appropriately profound facial groove in the enlarged end of the drive shaft 11 carries the roller races 53, whereby the distribution member 43 does not experience any of the driving forces acting on the pistons 50. A jaw-type clutch 54 couples the drive shaft 11 to the distribution member 43. This clutch permits an axial displacement of the distribution member 43 against the force of a return spring 55. The distribution bore 46 terminates in a distribution groove 56 disposed on the lateral surface of the distribution member 43 and which opens bores 57 located over the extent of the wall of the bushing 41 and which are connected with pressure lines 58 in the housing 10. The number of bores 57 or pressure lines 58 corresponds to the number of cylinders of the engine. Each of the pressure lines 58 is connected via further pressure lines, not shown, to one of the engine cylinders.

Surrounding the distribution member 43 is an annular slide 60 which has interior grooves 61 that control the termini of the fuel supply bores 47. The external surface of the annular slide 60 glides sealingly in a stepped bore 62 of the bushing 41 and is displaceable axially against a force of at least one return spring 63. A pressure chamber 64, defined by the distribution member 43, the bushing 41 and the annular slide 60, communicates through a regulator pressure line 65 with the cylindrical region 26 in the pressure regulating valve 8. Depending on the magnitude of the regulating pressure, the annular slide 60 is displaced to a higher or lower degree against the force of the return spring 63.

Figure 3:
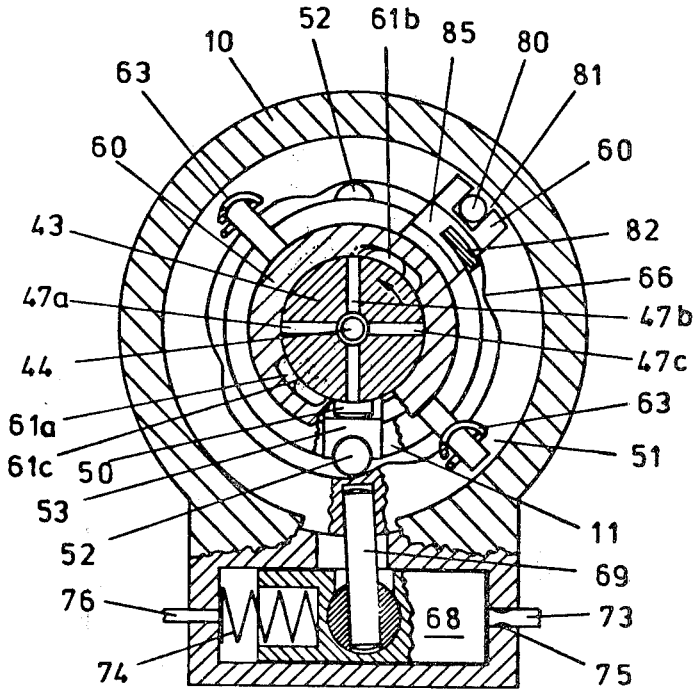
FIG. 3 is a cross section through the injection pump of the invention along the line III—III in FIG. 1.

As may be seen in FIG. 3, the limiting edges of the longitudinal grooves 61 are not parallel, so that, depending on the axial position of the annular slide 60 with respect to the distribution member 43, the region of the grooves 61 covered by the supply bores 47 during the rotation of the distribution member 43 is of different magnitude. In the exemplary embodiment illustrated, the supply bores 47 serve at the same time as influx bores as well as efflux bores for any fuel displaced by the pump pistons 50 but not used for injection. Thus, a fuel supply via the pressure valve 48 to the engine can take place only if the supply bores 47 are blocked. Any controlled closing of these bores during the pressurized fuel delivery of the pump pistons 50 will thus define the onset of fuel delivery whereas an opening of these bores will define the termination of fuel delivery. Depending on the particular disposition of the limiting edges of the control grooves, the fuel quantity may be controlled with respect to the onset of delivery or the termination of delivery. It will be understood that the supply bores 47 must be opened by the control grooves 61 at least during a portion of the suction stroke of the pump pistons 50. The grooves 61 become larger in the direction of the pressure chamber 64 so that, during a displacement of the annular slide 60 against the force of the spring 63, the injected fuel quantity decreases. In the exemplary embodiment illustrated in FIG. 3, the cam ring 51 has four cam lobes 66 and would thus be associated with a 4-cylinder internal combustion engine. As shown, the roller 52 is just ahead of the cam lobe 66, i.e., the groove **61*b* is in a position just prior to its separation from the supply bore 47*b*. As soon as this separation is complete, the cam-induced motion of the piston can initiate fuel injection. During further rotation of the distribution member 43, the supply bore 47*a* overlaps the groove 61*a* and the injection process is terminated. In the subsequent suction stroke of the piston 50, either the supply bore 47*a* still overlaps the groove 61*a* or else the supply bore 47*c* already overlaps the groove 61*b*. The edge 61*c* indicates the narrowest portion of the groove 61*a*. For example, if this edge 61*c* cooperates with the bore 47*a*, the mutual overlap of bore and groove is especially short, i.e., the injected fuel quantity is relatively large at some particular rpm. Furthermore, the bore 47** is only opened at a later time and the termination of the fuel supply is delayed so that the delivered fuel quantity is further enlarged if the onset of delivery remains constant, for example.

When the control of the annular slide 60 is considered together with the operation of the hydraulic pressure regulator 1, it is observed that a constriction of the throttle location 14 results in an increase of the static pressure and hence an increase of the regulating pressure which, in turn, causes a displacement of the annular slide into a position which is associated with a reduced injected fuel quantity. When the load remains constant, the reduced fuel quantity results in a decrease of rpm which decreases the static pressure and hence also decreases the regulating pressure whereupon the annular slide 60 is displaced into a position corresponding to a somewhat greater injected fuel quantity. In this manner, for any adjustment of the throttle, there is automatically regulated an associated engine speed (rpm). Since the cam 66 does not have a straight line contour but rather a sinusoidal contour, the speed of the piston at any rpm is different for different points of the track of the cam lobe. Fuel is delivered by a cam lobe only during the increasing portion of the cam track. However, since the portion of the increasing part of the cam lobe which causes fuel injection is different for different amounts of fuel, the piston speed is also variable as a function of the injection time. The speed of the piston has a certain influence on the quiet operation of the engine. The earlier the onset of delivery occurs with respect to the increasing cam lobe curve, the flatter is the slope of the curve, i.e., the lower the injection velocity. It turns out that, especially for small delivered fuel quantities, the injection velocity should be as low as possible to achieve quiet operation as idling. This can only be achieved by defining the amount of fuel via control of the end of the injection process or, if the injection quantity is controlled by grooves 61 which influence both the onset and the termination of fuel delivery, both the onset and termination must be shifted in the direction of the flatter curving extent of the cam lobe 66 in the cam ring 51 without rotating the cam ring 51 with respect to the drive shaft because such rotation would shift the entire injection process in the direction of early ignition which would result in noisy operation at low rpm. The injection time adjusting mechanism 3 may be given the independent task of advancing the onset of injection for high rpm so as to extend the otherwise relatively short preparation time at high rpm. For this reason, an rpm-dependent fuel injection time adjustment is especially desirable and, in some cases, even with a load-dependent influence.

An adjustment of the onset of injection is achieved in the apparatus according to the invention by a rotation of the cam ring 51 within the housing 10. This rotation is actuated by an injection adjustment piston 68 which engages the cam ring 51 via a bolt 69. The injection adjustment piston 68 is axially slidable in a cylindrical cavity 70 and is radially sealed, defining a pressure chamber 71 and a spring chamber 72. The pressure chamber 71 communicates via a conduit 73 with the control pressure line 16 whereby the control pressure engages the injection adjustment piston 68 against the force of a spring 74. Preferably, a throttle 75 is located in the line 73 just prior to its exit into the pressure chamber 71. Inasmuch as the control pressure increases with rpm, a displacement of the piston against the force of the spring implies a displacement of the onset of injection to an earlier time. Conversely, the normal or quiescent position of the adjustment piston 68 is associated with a late onset of injection. Each time the rollers 52 pass a cam lobe 66, they exert forces tending to rotate the cam ring 51 and thus to displace the piston 68 and it is the purpose of the throttle 75 to damp the effect of these forces. The time during which such an effect takes place during the rotation is relatively short so that relatively little fuel flows from the pressure chamber 71 through the throttle 75 back into the line 73, whereas a relatively long time is available for adjusting the position of the injection adjustment piston 68. In order to perform a second load-dependent control effort, the spring chamber 72 is connected through a line 76 with the pressure chamber 64 above the annular slide 60. Preferably, both during reduced fuel supply as well as during full-load operation of the injection pump, the pressure chamber 64 receives a fuel pressure from the pressure control valve 8 which, at full load, is just large enough to permit the spring 63 to push the annular slide securely against the cam 82 and, thus, the spring chamber 72 of the injection time adjustment mechanisms 3 also receives regulating pressure via the line 76. The presence of regulating pressure in the spring chamber 72 makes it possible to use the regulating pressure to change the pressure gradient between the pressure chamber 71 and the spring chamber 72 and thus also to change the onset of injection. Furthermore, the presence of the grooves 77 in the surface of the distribution member 43, in combination with the spring-loaded spring chamber 72, causes the hydraulic communication between the pressure chamber 64 and the spring chamber 72 to be interrupted during the time of fuel injection by the pistons 50 so that the undesirable oscillations of the injection adjustment piston 68 are further shortened. In the vicinity of the stepped bore 62, the bushing 41 has bores 78 which are opened by the external surface of the annular slide 60 after having traversed a certain stroke. Fuel may flow out of the pressure chamber 64 through these bores 78 so that the control pressure changes via lines 66 and 16. This change in the control pressure causes a displacement of the injection time adjustor piston 68 in the direction of the pressure chamber 71 so that the onset of injection time also changes in the direction of a later injection beginning with a certain rpm. As already mentioned above, it may be desirable to keep the driving speed of the pump piston 50 as low as possible at low rpm. This object is attained according to the invention by providing an axial guide bolt 80 within the cam ring 51 which guides the rotational position of the annular slide 60 by cooperation with a groove 81 therein. By disposing the springs in an oblique manner, a good contact is obtained between the guide bolt 80 and the wall of the groove 81. Thus, if the cam ring 51 is rotated, the guide bolt 80 also rotates the annular slide 60. Such a rotation of the annular slide 60 does not result in any change of the association of the grooves 61 and the fuel supply bores 47 but, if the guide bolt 80 is located obliquely, then the rotational position of the annular slide 60 will be different for different axial positions. Even though the relative rotation by the cam ring 51 is the same in each axial position of the annular slide, that relative rotation changes during a relative axial displacement. For certain conditions it may be desirable to change the full-load fuel quantity, i.e., the initial position of the annular slide, depending on rpm. For this purpose, there is disposed on the housing 10 at least one cam 82 which is attached by means of shims 83 and a screw 84 and which cooperates with a cam surface 85 on the annular slide 60. Depending on the rotational position of the annular slide 60, the initial position of the slide is easily changed. The basic initial position of the slide 60 may also be changed by choosing different shims 83. Another adjustment possibility is given by a screw 66 located in the plug 42 which can change the axial position of the distribution member 43 against the force of the spring 55. The manifold possibilities of regulation and control offered by the present invention make it possible to adapt the fuel injection quantity to any operational conditions of rpm and load and not merely at maximum rpm, namely by means of the cam 82 and the cam track 85 as well as by the freely selectable association and formation of the control edges of the grooves 61 and by the manner of generating the regulation pressure.

One problem occurring in ordinary fuel injection systems is the generation of a starting excess quantity during a starting of the engine. The starting excess quantities intend to achieve a rapid run-up from zero to just beyond the idling rpm and should be shut off thereafter. There should be no influence of the starting excess control process on the other regulatory aspects or pressure control mechanisms of the fuel injection system after the event of engine starting.

Figure 4:
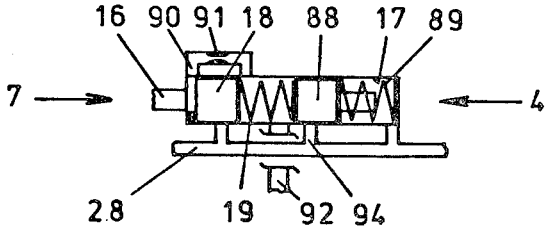
FIG. 4 illustrates a section from FIG. 1 in which the control piston is shown in its starting position.

FIG. 4 is an illustration of the pressure control valve 7 in a position assumed when the pump is standing still. The control pressure piston 18 is seen to be placed in its initial position by the control pressure spring 19. The control pressure cylinder 17 also includes a starting piston 88 which supports one end of the control pressure spring 19 on one face, whereas the other face supports a starting spring 89. The chambers of the control pressure cylinder 17 defined by this initial position of the control pressure piston 18 are connected via a bypass 90 which includes a throttle 91. The region of the cylinder 17 which includes the spring 19 is connected via a starting line 92 with a chamber 93 (see FIG. 1)

which is limited by the distribution member 43, the bushing 41 and the plug 42. Thus, prior to starting the engine, the control pressure line 16 is directly connected with the chamber 93 via the bypass 90 and the starting line 92. As soon as even a relatively low pressure is generated in the control pressure line 16 by the supply pump 9, the distribution member 43 is displaced against the force of the spring 55 until an overflow channel 67 is opened so as to limit the stroke. The distribution member 43 causes the fuel supply bores 47 to partially overlap the surface 59 in the interior bore of the annular slide so that, at the beginning of the pressure stroke of the pump pistons 50, no fuel may return into the pressure chamber 64. In this axial position, fuel may flow into the pump working chamber during the suction stroke only via the extended region **61*d* of the groove 61*b* which serves for supplying fuel to the pump working chamber 45. Thus the entire amount of fuel which is deliverable by the pump working chamber 45** is used for injection.

When the engine reaches approximately idling rpm, the throttle 91 in the bypass 90 (FIG. 4) causes a static pressure which tends to displace the pressure control piston 18 against the force of the spring 19 and thus close the bypass 90. During the increased tension of the control pressure spring 19, it displaces the starting piston 88 against the force of the starting spring 89 and thus opens a relief bore 94. The relief bore 94 terminates in the line 28 which communicates with the interior chamber 12 of the injection pump which is at low pressure. Thus, as soon as the starting piston 88 opens the relief bore 94, there is a communication between the chamber 93 and the low pressure line 98 via the starting line 92 so that the distribution member 43 is pushed back to its stop 86 and the process of delivering a starting excess fuel quantity is thereby terminated.

In order to achieve a smooth and uniform functioning of the fuel injection pump, it is desirable to have that pump attain its operating temperature as rapidly as possible yet to prevent over-heating even for extended periods of operation. For this purpose, the pump according to the invention includes a temperature control mechanism which employs the fuel supplied to the pump which is partially returned to the fuel container since the pre-supply pump, which is not shown, always delivers as much fuel as would be required by the injection pump under extreme and maximum conditions. As illustrated in FIG. 1, fuel is supplied by the pre-supply pump via line 96 to the inner chamber of the injection pump. From the inner chamber fuel then flows through a bore 97 to the suction side of the supply pump 9 and hence to the individual regulating and control mechanisms as well as to the inlet of the actual fuel injection pump. Any unused fuel flows through a pressure sustaining valve 98 which defines the inner chamber of the pump back to the fuel container. The pressure sustaining valve 98 is associated with an upstream thermostatic valve 99 which either connects the sustaining valve 98 directly to the suction line 96 via a channel 100 or connects the sustaining valve 98 with the line 28 leading to the inner chamber 12. When the pump is cold, the largest portion of the excess fuel flows off directly via the channel 100 so that any fuel in the inner chamber 12 has a chance to warm up before being aspirated by the fuel pump 9. When the fuel pump temperature increases, an increasing amount of fuel flows through the line 28 from the inner chamber 12 to the sustaining valve 98 while the passage through the channel 100 is decreased to a greater degree. Beginning with a certain pump temperature, virtually the entire excess fuel flows through the inner chamber 12 and the line 28 to the sustaining valve 98 and is then returned to the fuel container. The described mechanism and process insure a rapid heating of the pump to its operational temperature while preventing over-heating during extended operation.

The above-described characteristics are not limited to the illustrated and described combination, but are also intended to be viewed as independent inventions which may be used individually or in combination with already known characteristics.

Furthermore, the foregoing relates to preferred exemplary embodiments of the invention, it being understood that other embodiments and variants thereof are possible within the spirit and scope of the invention, the latter being defined by the appended claims.

What is claimed is:

1. In a fuel injection pump for an internal combustion engine, said pump including a fuel distributor member driven cyclically at a rate synchronous with engine speed and including an annular slide surrounding said distributor member having spatial features such as edges and grooves which cooperate with radial bores in said fuel distributor, and including a hydraulic regulator for axially displacing said annular slide which thereby regulates the amount of fuel delivered to said engine and further including a fuel supply pump for supplying fuel to said hydraulic regulator, the improvement comprising:

at least one arbitrarily settable throttle located in the conduit between said fuel supply pump and said hydraulic regulator mechanism for providing an rpm-dependent pressure gradient; and a spring-loaded pressure control valve connected downstream of said throttle for causing the pressure downstream of said throttle to increase with increasing fuel flow;

whereby the pressures prevailing upstream and downstream of said throttle influence the amount of axial displacement of said annular slide.

2. A fuel injection pump as defined by claim 1, the improvement further comprising a pressure regulator valve in said regulator, said pressure regulator valve including a sliding tensor piston for defining the spring tension of an associated regulator spring and being itself displaced by the fluid pressure prevailing upstream and downstream of said throttle and further including a regulator piston, urged by said regulator spring, for defining the opening in the fluid communication between said regulator and said pressure control valve.

3. A fuel injection pump as defined by claim 2, further comprising an actuating member for actuating said pressure regulator valve, so disposed that said actuating member displaces said tensor piston against a restoring force for an arbitrary actuation of the regulated pressure in the medium rpm domain of the engine.

4. A fuel injection pump as defined by claim 3, further comprising a fluid connection between said supply pump and a location downstream of said throttle; whereby, when a maximum supply pump pressure as defined by said throttle is exceeded, said tensor piston opens said connection.

5. A fuel injection pump as defined by claim 1, wherein said annular slide moves in the manner of a piston within a stepped bore of a housing also guiding said distributor member and wherein said distributor member, said annular slide and said housing together define a chamber to which is admitted the fluid pressure actuating said annular slide valve.

6. A fuel injection pump as defined by claim 5, further comprising a relief bore in said chamber, said relief bore being controlled by the movements of said annular slide.

7. A fuel injection pump as defined by claim 6, wherein the interior bore of said annular slide has at least one longitudinal groove terminating in an end face of said annular slide actuated by regulating pressure for the purpose of cooperating with said radial bores in said distributor member and controlling the free aperture therein.

8. A fuel injection pump as defined by claim 7, wherein said annular slide is axially guided and capable of limited rotation and wherein at least one of the limiting edges of said longitudinal grooves is non-parallel with respect to the longitudinal axis of said annular slide.

9. A fuel injection pump as defined by claim 8, wherein said radial bores in said distributor member which are controlled by said longitudinal groove serve at the same time as suction openings as well as overflow openings for controlling, respectively, the onset of fuel delivery and the termination of fuel delivery.

10. A fuel injection pump as defined by claim 1, further including radial pump pistons disposed slidably in said pump and a cam driven actuator mechanism for causing reciprocating motion of said radial pistons, a drive shaft extending through the housing of said fuel injection pump for operating said cam mechanism and adjusting means for changing the relative disposition of said cam mechanism and said pump pistons for the purpose of changing the onset of pumping and the onset of fuel delivery with respect to the angular position of said drive shaft and wherein said adjusting means includes an injection adjustment piston which is displaceable against a spring by the pressure of fluid from said pressure control valve.

11. A fuel injection pump as defined by claim 10, further comprising a throttle in the pressure line leading from said adjusting means to said regulator valve.

12. A fuel injection pump as defined by claim 10, wherein the end face of said injection adjustment piston not experiencing control pressure experiences regulated pressure.

13. A fuel injection pump as defined by claim 12, wherein said distributor member causes the communication between said regulating valve and said injection adjustment piston.

14. A fuel injection pump as defined by claim 13, wherein said injection adjustment piston is disposed to rotate said annular slide.

15. A fuel injection pump as defined by claim 14, wherein the initial position of said annular slide corresponding to full fuel delivery is changed by rotation through interaction of at least one cam track with a spatially fixed member.

16. A fuel injection pump as defined by claim 1, wherein said distributor member may be moved relative to said annular slide for the purpose of producing an engine starting excess quantity.

17. A fuel injection pump as defined by claim 16, wherein said distributor member is movable hydraulically against a restoring force and wherein said pump further includes an adjustable stop member for defining the initial position of said distributor member corresponding to full load operation.

18. A fuel injection pump as defined by claim 17, further including a starting control valve for adjusting the supply pump pressure fed to said distributor member.

19. A fuel injection pump as defined by claim 18, further comprising a bypass conduit causing communication between two separate chambers in said pressure control valve when a control piston within said pressure control valve is in its initial condition, said bypass including a throttle and communicating with the end face of said distributor member; whereby, in the normal operational position of said control piston in said pressure control valve, said bypass is closed thereby.

20. A fuel injection pump as defined by claim 19, wherein said pressure control valve includes a spring, one end of which urges said pressure control piston, whereas the other end of said pressure control spring is supported on a starting piston which permits communication between the end face of said distributor member and a pressure relief channel when said pressure control piston is displaced and obturates said bypass.

21. A fuel injection pump as defined by claim 1, further comprising thermostatic bypass means disposed between the fuel inlet to said fuel injection pump and a return line from said fuel injection pump, said thermostatic bypass remaining closed when said injection pump is at normal operating temperature.

22. A fuel injection pump as defined by claim 1, wherein said fuel injection pump employs pressure pistons whose displacement takes place in directions normal to the longitudinal axis of said distributor member.

* * * * *